US009484178B2

(12) United States Patent
Yamada et al.

(10) Patent No.: US 9,484,178 B2
(45) Date of Patent: Nov. 1, 2016

(54) TARGET AND X-RAY GENERATING TUBE INCLUDING THE SAME, X-RAY GENERATING APPARATUS, X-RAY IMAGING SYSTEM

(71) Applicant: CANON KABUSHIKI KAISHA, Tokyo (JP)

(72) Inventors: Shuji Yamada, Atsugi (JP); Tadayuki Yoshitake, Cambridge, MA (US); Yoichi Ikarashi, Fujisawa (JP); Takao Ogura, Yokohama (JP); Takeo Tsukamoto, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 22 days.

(21) Appl. No.: 14/687,749

(22) Filed: Apr. 15, 2015

(65) Prior Publication Data

US 2015/0303022 A1 Oct. 22, 2015

(30) Foreign Application Priority Data

Apr. 21, 2014 (JP) ..... 2014-087465

(51) Int. Cl.

| | |
|---|---|
| ***H01J 35/08*** | (2006.01) |
| ***H01J 35/16*** | (2006.01) |
| *G21K 1/02* | (2006.01) |
| *H05G 1/06* | (2006.01) |

(52) U.S. Cl.

CPC ..... *H01J 35/08* (2013.01); *H01J 35/16* (2013.01); *G21K 1/02* (2013.01); *H01J 2235/081* (2013.01); *H01J 2235/087* (2013.01); *H01J 2235/166* (2013.01); *H05G 1/06* (2013.01)

(58) Field of Classification Search

USPC ..... 378/143

See application file for complete search history.

(56) References Cited

U.S. PATENT DOCUMENTS

| | | | | |
|---|---|---|---|---|
| 6,850,598 | B1 | 2/2005 | Fryda | |
| 2015/0110244 | A1* | 4/2015 | Tsujino | G01N 23/06 378/58 |

FOREIGN PATENT DOCUMENTS

| | | | |
|---|---|---|---|
| JP | 2009545840 | A | 12/2009 |

* cited by examiner

*Primary Examiner* — Kiet T Nguyen

(74) *Attorney, Agent, or Firm* — Canon U.S.A. Inc., IP Division

(57) ABSTRACT

The target includes a target layer configured to be irradiated with an electron to generate an X-ray and a support substrate configured to support the target layer. The support substrate includes a polycrystalline diamond and includes multiple structure planes having different area densities of plane orientations from one another. The target layer is supported by the support substrate at a structure plane with a smaller area density of the {101} plane than the area density of the {100} plane and the area density of the {111} plane.

19 Claims, 6 Drawing Sheets

NORMALIZED AREA RATIO OF PLANE 101 $NS_{101}$=19.2%

NORMALIZED AREA RATIO OF PLANE 101 $NS_{101}$=38.7%

NORMALIZED AREA RATIO OF PLANE 101 $NS_{101}$=21.1%

TARGET AND X-RAY GENERATING TUBE INCLUDING THE SAME, X-RAY GENERATING APPARATUS, X-RAY IMAGING SYSTEM

BACKGROUND OF THE INVENTION

1. Field of the Invention

The present invention relates to X-ray generating tubes applicable to diagnosis applications in medical apparatuses, non-destructive X-ray imaging in the field of industrial apparatuses, and the like. In particular, the present invention relates to transmissive targets applicable to the X-ray generating tubes.

2. Description of the Related Art

There have been demands for increasing the durability of X-ray generating apparatuses configured to generate X-rays in order to reduce the necessity of maintenance. One of the main factors that determine the durability of an X-ray generating apparatus is thermal resistivity of a target that is an X-ray source.

In an X-ray generating apparatus configured to irradiate a target with an electron beam to generate X-rays, the "X-ray generation efficiency" of the target is about 1%, so most of the energy input to the target is converted into heat. If the heat generated in the target is not adequately "released," the target may be damaged by the heat load, which imposes restrictions on the thermal resistivity of the target.

It is publicly known to use a transmissive target including a target layer in the form of a thin film containing a heavy metal and a substrate configured to transmit X-rays and support the target layer in order to improve the "X-ray generation efficiency" of the target. Japanese Patent Application Laid-Open No. 2009-545840 discusses a transmissive target with an "X-ray generation efficiency" that is 1.7 to 2.0 times greater than those of the conventional rotating anode reflection targets.

It is publicly known to use a diamond as a substrate supporting a target layer of a layered target to promote the "release of heat" from the target to the outside. U.S. Pat. No. 6,850,598 discusses using a monocrystalline or polycrystalline diamond as a substrate supporting a target layer to improve the heat releasing property and decrease the focal spot. Having high thermal resistivity, high heat conductivity, and high X-ray transmittivity, diamonds are a suitable material for use as a support substrate of a transmissive target. Polycrystalline and monocrystalline diamonds have similar heat properties, but polycrystalline diamonds are advantageous in that they are inexpensively available.

Polycrystalline diamonds have physical properties similar to those of monocrystalline diamonds in terms of heat conductivity, thermal resistivity, and X-ray transmittivity as a support substrate for use in a transmissive X-ray target. Further, polycrystalline diamonds are more advantageous than monocrystalline diamonds in that millimeter-order sized support substrates can be supplied inexpensively and stably.

However, as a result of intensive and extensive studies conducted by the present inventors, it has been confirmed that when a transmissive target using a polycrystalline diamond as a support substrate is repeatedly operated as discussed in U.S. Pat. No. 6,850,598, a problem arises that X-ray outputs decrease or discharge occurs.

SUMMARY OF THE INVENTION

Aspects of the present invention are directed to providing a transmissive target that includes a support substrate containing a polycrystalline diamond and is less likely to cause a decrease in X-ray outputs or a discharge even when the transmissive target is operated repeatedly. Aspects of the present invention are also directed to providing an X-ray generating tube, an X-ray generating apparatus, and an X-ray imaging system that are highly reliable and less likely to cause a decrease in X-ray outputs or a discharge.

Aspects of the present invention can provide a transmissive target that is less likely to cause a decrease in the adhesion between a support substrate containing a polycrystalline diamond and a target layer even when the transmissive target is operated repeatedly so that neither a discharge nor a decrease in anode current is likely to occur.

Further, a transmissive target according to an exemplary embodiment of the present invention is employed for an X-ray generating tube so that an X-ray generating tube, an X-ray generating apparatus, and an X-ray imaging system that are highly reliable and less likely to cause a discharge or a decrease in anode current even when they are operated repeatedly can be provided.

According to an aspect of the present invention, a target includes a target layer configured to be irradiated with an electron to generate an X-ray and a support substrate configured to support the target layer, wherein the support substrate is a polyhedron containing a polycrystalline diamond and including multiple structure planes having different area densities of plane orientations from one another, and wherein the target layer is supported by the support substrate at a structure plane with a smaller area density of a {101} plane than each of an area density of a {100} plane and an area density of a {111} plane.

According to another aspect of the present invention, a target includes a target layer configured to be irradiated with an electron to generate an X-ray and a support substrate configured to support the target layer, wherein the support substrate is a polyhedron containing a polycrystalline diamond and including multiple structure planes each of which has a normal line from one another, and wherein the target layer is supported by the support substrate at a structure plane with a smaller normalized area density of a monocrystalline domain showing a {101} plane than each of a normalized area density of a monocrystalline domain showing a {100} plane and a normalized area density of a monocrystalline domain showing a {111} plane.

The area densities in the multiple structure planes are denoted by $S_{101}$, $S_{100}$, and $S_{111}$ corresponding to plane orientations {101}, {100}, and {111}, and each of the area densities of the multiple structure planes is a normalized area density obtained by normalizing by an area of the structure plane a total value of areas of monocrystalline domains showing a plane orientation with an angle of deviation of 10 degrees of smaller from a central axis of the plane orientation. Further, normalized area densities $NS_{101}$, $NS_{100}$, and $NS_{111}$ corresponding to the plane orientations {101}, {100}, and {111} are represented by general formulas 1 to 3:

$$NS_{101}=S_{101}/(S_{101}+S_{100}+S_{111}) \quad \text{(general formula 1),}$$

$$NS_{100}=S_{100}/(S_{101}+S_{100}+S_{111}) \quad \text{(general formula 2), and}$$

$$NS_{111}=S_{111}/(S_{101}+S_{100}+S_{111}) \quad \text{(general formula 3).}$$

Further features of the present invention will become apparent from the following description of exemplary embodiments with reference to the attached drawings.

DESCRIPTION OF THE EMBODIMENTS

Various exemplary embodiments of the present invention will be described in detail below with reference to the drawings. It is to be understood that the sizes, materials, shapes, relative positions, and the like of components described in the following exemplary embodiments are not intended to limit the scope of the invention.

Figure 2:
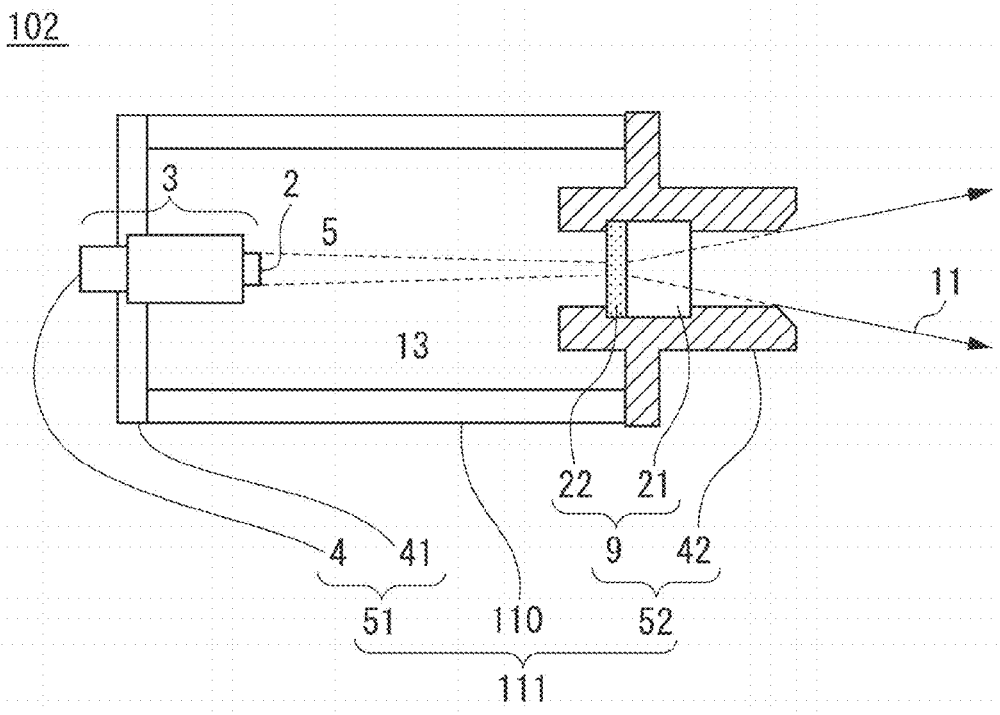
FIG. 2 is a configuration diagram illustrating an X-ray generating tube including a transmissive target according to an exemplary embodiment of the present invention.
Figure 3:
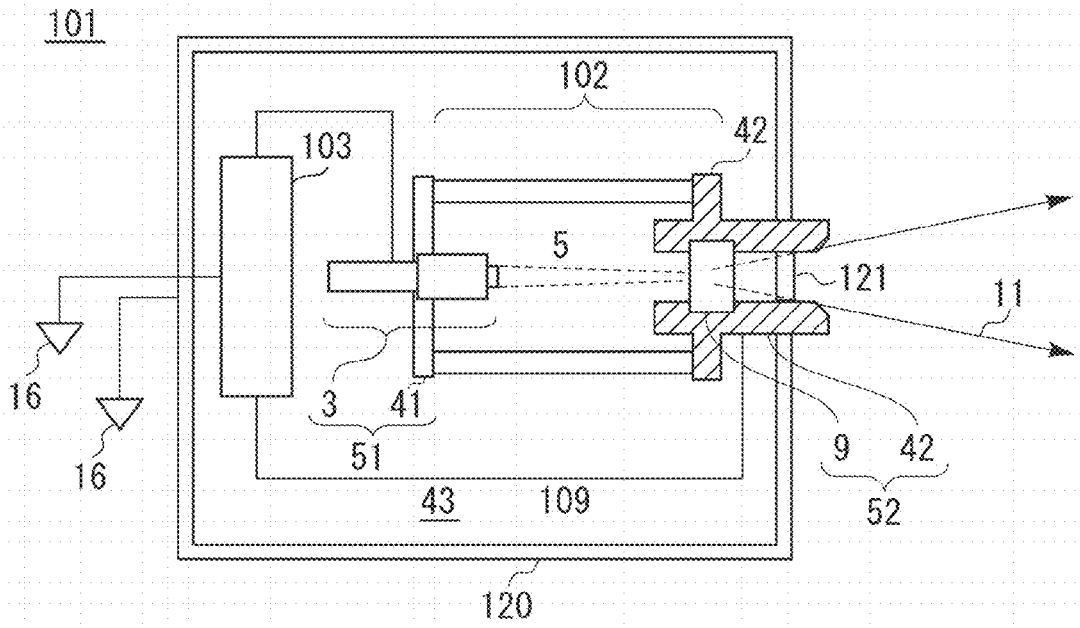
FIG. 3 is a configuration diagram illustrating an X-ray generating apparatus including an X-ray generating tube according to an exemplary embodiment of the present invention.

First, an X-ray generating tube and an X-ray generating apparatus to which a transmissive target according to an exemplary embodiment of the present invention is applicable will be described below. FIG. 2 is a configuration diagram illustrating an X-ray generating tube 102 including a transmissive target 9 according to the exemplary embodiment of the present invention. FIG. 3 is a configuration diagram illustrating an X-ray generating apparatus 101 according to the exemplary embodiment of the present invention.

<X-Ray Generating Tube>.

FIG. 2 illustrates the transmissive X-ray generating tube 102 including an electron emission source 3 and the transmissive target 9 according to the exemplary embodiment. Hereinafter, the transmissive target 9 will be simply referred to as the target 9.

In the present exemplary embodiment, a target layer 22 is irradiated with an electron beam flux 5 emitted from an electron emitting unit 2 of the electron emission source 3 to generate X-rays. Thus, the target layer 22 is disposed on the side of a support substrate 21 that faces the electron emission source 3, and the electron emitting unit 2 is disposed on the side of the electron emission source 3 that faces the target layer 22.

Further, as illustrated in FIG. 2, the emission angle of X-rays generated at the target layer 22 is limited as necessary by a collimator having an opening in front of the target 9 to form the X-rays into an X-ray flux 11. In the present exemplary embodiment, a tubular anode member 42 having an opening around the target 9 to hold the target 9 functions as the collimator.

Electrons contained in the electron beam flux 5 are accelerated by an acceleration electric field generated by a cathode 51 and an anode 52 in an internal space 13 of the X-ray generating tube 102, up to an incident energy required for the target layer 22 to generate X-rays.

In the present exemplary embodiment, the anode 52 includes at least the target 9 and the anode member 42 and functions as an electrode defining the anode potential of the X-ray generating tube 102.

The anode member 42 is made of a conductive material and electrically connected to the target layer 22. The anode member 42 contains a heavy metal such as tungsten or tantalum. As illustrated in FIG. 2, the anode member 42 includes a portion extending with an opening in front of the target 9 to function as the collimator. Details of the target 9 according to the exemplary embodiment will be described below.

A vacuum is created in the internal space 13 of the X-ray generating tube 102 to ensure a mean free path of the electron beam flux 5. The degree of vacuum in the X-ray generating tube 102 is desirably 1E-8 Pa to 1E-4 Pa, more desirably 1E-8 Pa to 1E-6 Pa from the point of view of the lifetime of the electron emission source 3. In the present exemplary embodiment, the electron emitting unit 2 and the target layer 22 respectively are disposed within the internal space 13 or on an interior surface of the X-ray generating tube 102.

The internal space 13 of the X-ray generating tube 102 is evacuated with an exhaust tube (not illustrated) and a vacuum pump (not illustrated), and then the exhaust tube is sealed to create a vacuum in the internal space 13. Further, a getter (not illustrated) may be disposed within the internal space 13 of the X-ray generating tube 102 to maintain the degree of vacuum.

The X-ray generating tube 102 includes at a body part an insulation tube 110 for electrical insulation between the electron emission source 3 set to a cathode potential and the target layer 22 set to an anode potential. The insulation tube 110 is made of an insulating material such as a glass material, a ceramic material, etc. Both end portions of the insulation tube 110 in the tube axis direction are sandwiched by the cathode 51 and the anode 52 to define the distance between the electron emitting unit 2 and the target layer 22.

An envelope 111 desirably includes members that are airtight to maintain the degree of vacuum of the internal space 13 and are also robust to be resistant to atmospheric pressure. In the present exemplary embodiment, the envelope 111 includes the insulation tube 110, the cathode 51 including the electron emission source 3, and the anode 52 including the target 9.

Thus, the cathode 51 and the anode 52 according to the present exemplary embodiment respectively are connected to opposite end portions of the insulation tube 110 to constitute a part of the envelope 111. Similarly, the support substrate 21 plays a role as a transmission window for releasing X-rays generated at the target layer 22 to the outside of the X-ray generating tube 102 and also constitutes a part of the envelope 111.

The electron emission source 3 may use a hot cathode such as a filament cathode containing a heat-resistant metal such as tungsten or an impregnated cathode or a cold cathode such as a carbon nanotube. The electron emission source 3 may include a grid electrode (not illustrated) or an electrostatic lens electrode (not illustrated) to control the beam diameter and electron current density of the electron beam flux 5, on/off timing, etc.

<X-Ray Generating Apparatus>

FIG. 3 illustrates the configuration of the X-ray generating apparatus 101 including the X-ray generating tube 102 according to the exemplary embodiment. The X-ray generating apparatus 101 according to the present exemplary embodiment includes the X-ray generating tube 102, which is an X-ray source, and a tube voltage circuit 103 in a container 120 having an X-ray transmission window 121. The tube voltage circuit 103 is configured to apply tube voltage to the X-ray generating tube 102.

A tube voltage Va to be output by the tube voltage circuit 103 is set as appropriate for the target layer 22 and the radiation type necessary for radiography.

The container 120 containing the X-ray generating tube 102 and the tube voltage circuit 103 desirably has sufficient strength as a container and excellent heat releasing property. A metal material such as brass, iron, stainless-steel, etc. is used as a material of the container 120

In the present exemplary embodiment, an extra space 43 other than the X-ray generating tube 102 and the tube voltage circuit 103 in the container 120 is filled with an insulating liquid 109. The insulating liquid 109 is an electrically insulating liquid and plays a role to maintain the electrical insulation within the container 120 and also plays a role as a cooling medium of the X-ray generating tube 102. Desirably, an electrically insulating oil such as a mineral oil, silicone oil, perfluoro-based oil, etc. is used as the insulating liquid 109

Further, an insulating resin (not illustrated) containing a glass fiber, polyethylene, etc. may be provided to an interior surface of the container 120 to further improve the electrical insulation between the X-ray generating tube 102, the tube voltage circuit 103, interconnections, etc. and the container 120.

<X-Ray Imaging System>

Figure 4:
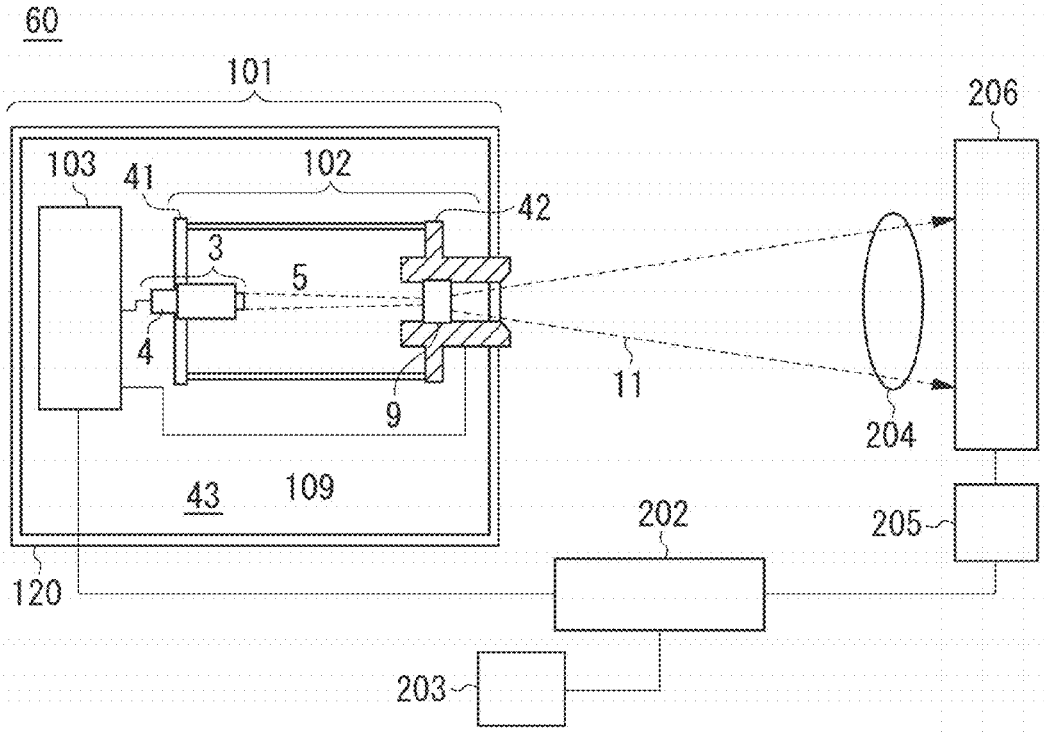
FIG. 4 is a configuration diagram illustrating an X-ray imaging system including an X-ray generating apparatus according to an exemplary embodiment of the present invention.

The following describes an example of the configuration of an X-ray imaging system 60 including the target 9 according to the exemplary embodiment of the present invention, with reference to FIG. 4.

A system control unit 202 comprehensively controls the X-ray generating apparatus 101 and an X-ray detection unit 206. The tube voltage circuit 103 according to the present exemplary embodiment outputs various types of control signals to the X-ray generating tube 102 under the control by the system control unit 202. While the tube voltage circuit 103 is contained together with the X-ray generating tube 102 in the container 120, the tube voltage circuit 103 may be disposed outside the container 120. The emission state of the X-ray flux 11 emitted from the X-ray generating apparatus 101 is controlled by the control signals output by the tube voltage circuit 103.

The irradiation range of the X-ray flux 11 emitted from the X-ray generating apparatus 101 is adjusted by a collimator unit (not illustrated) including a movable diaphragm, and the X-ray flux 11 is emitted to the outside of the X-ray generating apparatus 101, passes through a subject 204, and is detected by the detection unit 206. The detection unit 206 converts the detected X-ray into an image signal and outputs the image signal to a signal processing unit 205.

The signal processing unit 205 performs predetermined signal processing on the image signal under the control by the system control unit 202 and outputs the processed image signal to the system control unit 202.

The system control unit 202 outputs to a display apparatus 203 a display signal for displaying an image on the display apparatus 203 based on the processed image signal.

The display apparatus 203 displays on a screen an image based on the display signal as a captured image of the subject 204.

The X-ray imaging system 60 can be used in non-destructive inspection of industrial products and pathological diagnosis of human bodies and animals.

<Target>

Figure 1A:
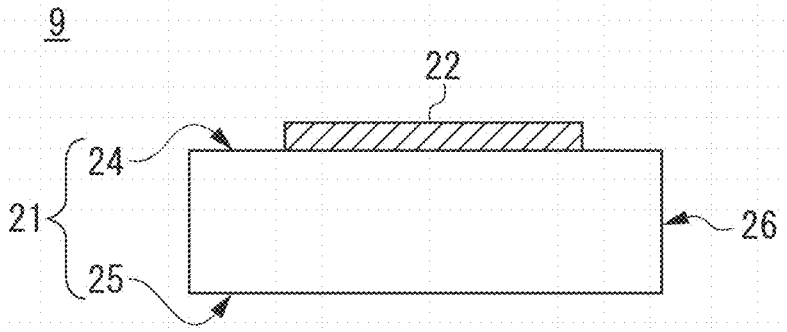
FIG. 1A is a configuration diagram illustrating a transmissive target according to an exemplary embodiment of the present invention.
Figure 1B:
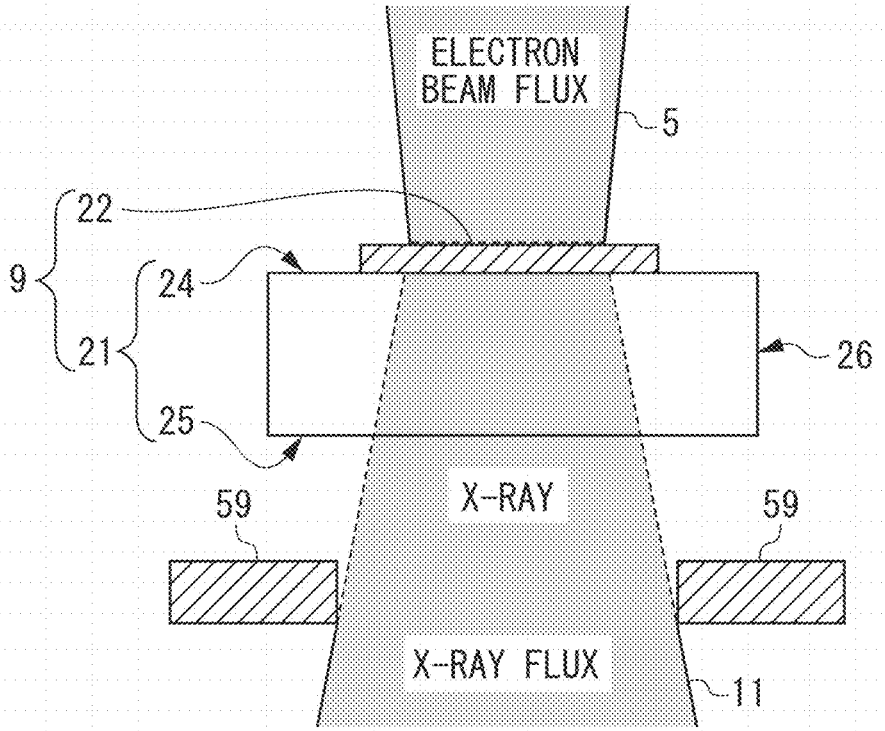
FIG. 1B illustrates an operation state of the transmissive target.

The following describes the target 9, which is a feature of the exemplary embodiment of the present invention, with reference to FIGS. 1A and 1B.

The target 9 illustrated in FIG. 1A includes at least the target layer 22 containing a target metal described below and the support substrate 21 supporting the target layer 22. FIG. 1B illustrates an operation state of the target 9 illustrated in FIG. 1A. The target layer 22 is irradiated with the electron beam flux 5 to emit X-rays.

In an X-ray emitting tube including the target 9 according to the exemplary embodiment of the present invention, a part of the components of X-rays emitted from the target layer 22 and having passed in the thickness direction of the support substrate 21 is shaped into the X-ray flux 11 by a collimator 59 having an opening and released forward from the support substrate 21. For convenience of understanding, only emitted components of X-rays generated radially from the focal spot of the electron beam flux 5 irradiating the target layer 22 that are within the range connecting the X-ray flux 11 and the focal spot together are surrounded and indicated in broken lines in FIG. 1B.

The support substrate 21 is a polyhedron with multiple structure planes 24, 25, and 26 each of which has a normal line from one another. Further, the support substrate 21 is made of a polycrystalline diamond and formed by a chemical vapor deposition method (CVD method), a solid phase sintering method in which a microcrystal diamond is sintered, a liquid phase sintering method in which a binder metal such as cobalt and a microcrystal diamond are sintered by dissolution and precipitation actions, or the like. From the point of view of the quality of X-rays and heat conductivity, it is desirable to use the CVD method by which a polycrystalline diamond with high purity of carbon and sp3 bond framework can be obtained.

A polycrystalline diamond formed using the CVD method is formed by conducting a layer forming process in which a crystal of polycrystalline diamond is grown on a seed crystal substrate to deposit a polycrystalline diamond layer. A process of mechanically or chemically removing the seed crystal substrate from a layered product in which the polycrystalline diamond is formed by CVD is conducted so that a free-standing polycrystalline diamond can be formed.

As illustrated in FIG. 1A, the exterior shape of the support substrate 21 is a flat plate shape including the structure planes 24 and 25. The structure plane 24 supports the target layer 22. The structure plane 25 is on the opposite side from the structure plane 24, and X-rays are released from the structure plane 25. The exterior shape of the support substrate 21 is selected from, for example, a cuboid shape, a disk shape, and a truncated cone shape.

In the case where the support substrate 21 is in the shape of a disk, the diameter may be set within the range of 2 mm to 10 mm, inclusive, so that the target layer 22 capable of forming a focal spot of an electron beam having a necessary focal spot diameter can be disposed. The thickness of the support substrate 21 may be set within the range of 0.3 mm to 3 mm, inclusive, so that the transmittivity of radiation can be ensured. In the case where the support substrate 21 is a cuboid-shaped diamond substrate, the respective lengths of the shorter and longer sides of faces of the cuboid may be set within the diameter range specified above.

The target layer 22 contains as the target metal a metal element having a high atomic number, a high melting point, and a high specific gravity. From the point of view of affinity with the support substrate 21, the target metal is desirably at least one metal selected from the group consisting of tantalum, molybdenum, and tungsten, a carbide of which has a negative standard thermodynamic quantity. The form in which the target metal is contained in the target layer 22 is selected from metal compounds of pure metals, carbides, nitrides, oxynitrides, etc. with a single or alloy composition as appropriate from the point of view of the melting point, specific gravity, heat conductivity, etc.

The layer thickness of the target layer 22 is selected from the range of 1 μm to 12 μm, inclusive. The upper and lower limits of the thickness of the target layer 22 respectively are determined from the point of view of obtaining the X-ray output intensity and reducing the interface stress, and the layer thickness is more desirably set within the range of 3 μm to 9 μm, inclusive.

As illustrated in FIG. 2, the target 9 constitutes the anode 52 of the X-ray generating tube 102 together with the anode member 42 and a brazing filler metal (not illustrated).

The brazing filler metal has a function of holding the target 9 on the anode member 42 and also a function of electrically connecting the target layer 22 and the anode member 42 together. The brazing filler metal is an alloy containing gold, silver, copper, tin, etc., and bonding properties suitable for a member to be joined can be obtained by selecting the alloy composition of the brazing filler metal as appropriate.

The following describes the thermal damage to the target, which is a technical problem to be solved by the present invention.

The present inventors have analyzed the target of the X-ray generating tube with a decreased X-ray output intensity as a result of repeated irradiation operations. As a result, the present inventors have acquired the following findings.

First, in the target with a decreased X-ray output, the target layer peeled from the support substrate, and it was found that the adhesion of the target layer is decreased.

Second, a region denatured from diamond to graphite was observed at the interface between the target layer with decreased adhesion and the polycrystalline diamond being the support substrate.

Third, it was found that denaturation to graphite is significant in a structure plane having relatively more {101} plane orientation components than other plane orientation components.

Although the mechanism of denaturation of the polycrystalline diamond immediately below the peeled region of the target layer is unknown, from the studies conducted by the present inventors it was presumed that the following elementary processes proceeds concurrently with the X-ray generation operation.

Elementary Process 1: Thermal Denaturation

This is an elementary process in which a part of an sp3 bond of a diamond having the sp3 bond as a framework is thermally changed to an sp2 bond by heat produced by a region irradiated with an electron beam, whereby the diamond is denatured to graphite.

Elementary Process 2: Local Expansion of Support Substrate

As a result of the denaturation from the monocrystalline domain having a high specific gravity (specific gravity of diamond: 3520 kg/m$^3$) to the graphite having a low specific gravity (specific gravity: 2200 kg/m$^3$), a part of the support substrate expanded toward the target layer to apply stress to the joint interface.

The following describes the third finding from which the elementary process 1 was presumed. The present inventors measured the speed of the denaturation to graphite by use of a monocrystalline diamond specimen including as structure planes the plane orientations of planes 100, 101, and 111 in the temperature range of 1500° C. to 2200° C. As a result, the activation energies of the denaturation to graphite were 640 kJ/mol for the {101} plane and 955 kJ/mol for the {111} plane. The activation energy of the denaturation to graphite for the {100} plane could not be quantified because the speed of the denaturation to graphite could not be obtained, but it was presumed that the activation energy for the {100} plane is at least 1100 kJ/mol or higher. From the foregoing, it was confirmed that the denaturation from the sp3 bond to the sp2 bond is dependent on the plane orientation components of the diamond.

Thus, it was found that a structure plane with a larger area of a monocrystalline domain showing the {101} plane than the area of a monocrystalline domain of other plane orientation is not suitable for use as a plane to support the target layer because denaturation to graphite is promoted. On the other hand, it was also found that a structure plane with a smaller area of a monocrystalline domain showing the {101} plane than the area of a monocrystalline domain of other plane orientation is suitable for use as a plane to support the target layer because denaturation to graphite is restrained.

The following describes the non-uniformity of plane orientation components of a transmission substrate containing a polycrystalline diamond, which is a feature of the exemplary embodiment of the present invention, with reference to FIGS. 5A, 5B, 5C, and 5D.

Figure 5A:
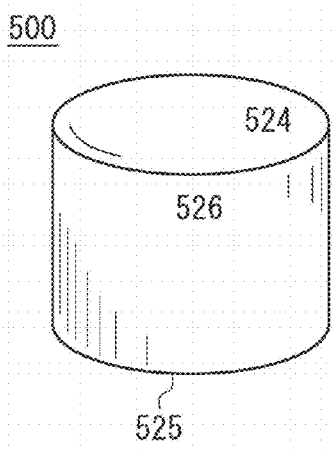
FIG. 5A illustrates an outer shape of a polycrystalline diamond specimen, and FIGS. 5B, 5C, and 5D respectively illustrate observed images 5B to 5D on structure planes 524 to 526 obtained by an electron backscattering diffraction method (EBSD method).

FIG. 5A illustrates a polycrystalline diamond specimen 500 in which varying area densities of plane orientations between structure planes were observed. The polycrystalline diamond specimen 500 is in the shape of a disk having an exterior shape with a diameter of 2 mm and a thickness of 2 mm. The polycrystalline diamond specimen 500 includes the following structure planes, bottom faces 524 and 525 located opposite from each other and a side face 503. The polycrystalline diamond specimen 500 was prepared by sintering monocrystalline grains with an average grain size of several micron meters by use of the solid phase sintering method and then shaping the sintered monocrystalline grains by dicing, polishing, etc. The surface roughness Ra of each face of the polycrystalline diamond specimen 500 was 0.5 μm or lower.

Figure 5B:
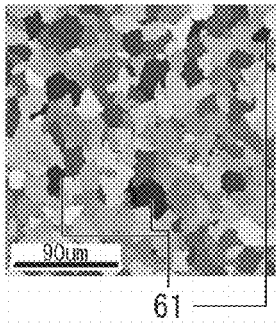
Figure 5B:
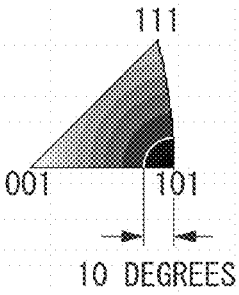
Figure 5C:
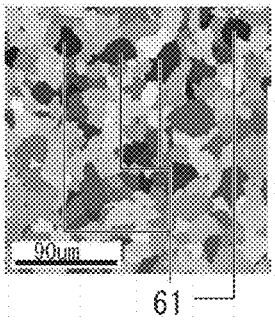
Figure 5C:
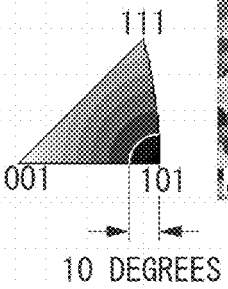
Figure 5D:
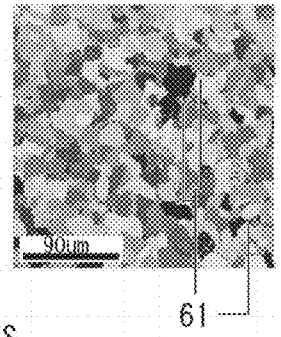
Figure 5D:
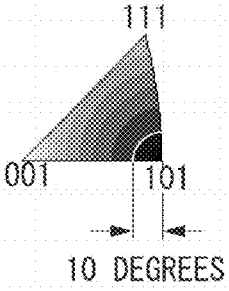

FIGS. 5B to 5D illustrate observation results of crystal domains of the respective structure planes of the polycrystalline diamond specimen 500 observed by electron backscatter diffraction. In the mapping illustrated in each of FIGS. 5B to 5D, the planes 101 are indicated in black and the planes 100 with a plane orientation forming an angle of deviation of 45.2 degrees from a {101} plane in white. Further, each {111} plane forms an angle of 35.5 degrees from a {101} plane and is indicated in whitish gray in the mapping. On the right hand side of each polycrystalline image in FIGS. 5B to 5D is illustrated a fan-shaped legend.

An electron backscattering diffraction method (EBSD method) uses the phenomenon that an electron beam emitted to a test subject containing a crystalline material and backscattered from the test subject exhibits an EBSD pattern. Further, the EBSD method uses the fact that the EBSD pattern contains information on the crystal shape and orientation. The EBSD pattern is also referred to as a Kikuchi line diffraction pattern.

Further, the EBSD method in combination with a scanning electron microscope (SEM) can obtain information on the crystal shape and orientation of a minute region by scanning a test subject with electron beam irradiation and measuring and analyzing an EBSD pattern. In each observation image, a region with uniform concentration is a monocrystalline domain in which crystal orientations are the same, and a boundary between the monocrystalline domains corresponds to a crystal grain boundary.

In the exemplary embodiment of the present invention, the area of monocrystalline domains included in a structure plane of a polycrystalline diamond is obtained by extracting monocrystalline domain regions included in a polycrystalline image observed by the EBSD method and then calculating the area of the extracted regions. To identify area densities, the size of an evaluation region of the test subject is selected from the range of 100 $\mu m^2$ to several $mm^2$ to include 100 to 10000 monocrystalline domains in the evaluation region.

FIG. 5B illustrates a polycrystalline image of the structure plane 524 of the polycrystalline diamond specimen 500 obtained by the EBSD method. The area density of monocrystalline domains 61 showing the {101} plane in the structure plane 524 was 9.2%. Similarly, the area density of monocrystalline domains showing the {100} plane in the structure plane 524 was 12.8%, and the area density of monocrystalline domains showing the {111} plane in the structure plane 524 was 25.9%. Accordingly, it was found that in the structure plane 524, the area density of the monocrystalline domains showing the {101} plane is smaller than the area density of the monocrystalline domains showing the {100} plane and also smaller than the area density of the monocrystalline domains showing the {111} plane.

While a polycrystalline image in general includes high-order plane orientations, the three plane orientations {101}, {100}, and {111} is defined as index plane orientations herein. The monocrystalline domains with an angle of deviation of 10 degrees or smaller from a central axis 101, 100, or 111 of the index plane orientations were considered equivalent to the index plane orientations in reactivity in the denaturation to graphite and, thus, merged. Accordingly, area densities $S_{101}$, $S_{100}$, and $S_{111}$ corresponding to the plane orientations {101}, {100}, and {111} in a structure plane are normalized area densities obtained by normalizing by the area of the structure plane a total value of the areas of monocrystalline domains with an angle of deviation of 10 degrees or smaller from the central axis of the plane orientation. In each legend in FIGS. 5B to 5D, the boundary between the merged {101} plane orientation components and other plane orientation components is indicated in a solid line arc.

Identification of the area densities $S_{101}$, $S_{100}$, and $S_{111}$ can be determined using the EBSD evaluation regions as representatives of the structure planes. Specifically, identification of the area densities $S_{101}$, $S_{100}$, and $S_{111}$ can be determined by normalizing by the area of the evaluation region the total value of the areas of the monocrystalline domains with an angle of deviation of 10 degrees or smaller from the central axis of the plane orientation in the evaluation region which is an observed region of the structure plane.

In the present specification, the components of the index plane orientations of each structure plane are evaluated using a normalized area density NS obtained by normalizing an area densities of interest by a total value of the area densities $S_{101}$, $S_{100}$, and $S_{111}$, as specified by the following general formulas 1 to 3:

$$NS_{101}=S_{101}/(S_{101}+S_{100}+S_{111}) \quad \text{(general formula 1)},$$

$$NS_{100}=S_{100}/(S_{101}+S_{100}+S_{111}) \quad \text{(general formula 2), and}$$

$$NS_{111}=S_{111}/(S_{101}+S_{100}+S_{111}) \quad \text{(general formula 3)}.$$

Since $NS_{101}+NS_{100}+NS_{111}$, which is the total value of the normalized area densities, is 100%, the normalized area density NS of a major plane orientation component is higher than 33.3%, whereas the normalized area density NS of a minor plane orientation component is at least 33.3% or lower.

Accordingly, the normalized area density $NS_{101}$ of the {101} plane of the structure plane 524 illustrated in FIG. 5B was 19.2%.

Further, as in FIG. 5B, FIG. 5C illustrates a polycrystalline image of the structure plane 525 of the polycrystalline diamond specimen 500 observed by the EBSD method. The area densities $S_{101}$, $S_{100}$, and $S_{111}$ of the structure plane 525 were 18.9%, 9.4%, and 20.5%, respectively. Accordingly, it was found that the area density of monocrystalline domains showing the {101} plane in the structure plane 525 is higher than the area density of monocrystalline domains showing the {100} plane in the structure plane 525 and is lower than the area density of monocrystalline domains showing the {111} plane in the structure plane 525. The normalized area density $NS_{101}$ of the {101} plane of the structure plane 525 was 38.7%.

Further, as in FIG. 5B, FIG. 5D illustrates a polycrystalline image of the structure plane 526 of the polycrystalline diamond specimen 500 observed by the EBSD method. The area densities $S_{101}$, $S_{100}$, and $S_{111}$ of the structure plane 526 were 12.5%, 22.5%, and 24.5%, respectively. Accordingly, it was found that the area density of monocrystalline domains showing the {101} plane in the structure plane 526 is smaller than the area density of monocrystalline domains showing the {100} plane in the structure plane 526 and also smaller than the area density of monocrystalline domains showing the plane 111 in the structure plane 526. The normalized area density $NS_{101}$ of the {101} plane of the structure plane 526 was 21.1%.

It was confirmed that there is a case where the area densities of the plane orientations in the structure planes 524 to 526 of the polycrystalline diamond specimen 500 are different from one another. It is presumed that the difference in the area densities of the plane orientations among the structure planes is due to non-uniformity of the components of the plane orientations resulting from unavoidable unevenness such as temperature unevenness, pressure unevenness, precipitation, etc. during the process of forming the polycrystalline diamond specimen 500.

As described above, a polycrystalline diamond can be formed by the chemical vapor deposition method, the solid phase sintering method, the liquid phase sintering method, etc. In any case, it is considered that due to production constraints, it is difficult to completely eliminate non-uniformity of the area densities of the plane orientations.

From the first to third findings obtained as a result of intensive and extensive studies conducted by the present inventors and others, the target having a feature of the exemplary embodiment of the present invention is specified.

Specifically, the target according to the exemplary embodiment of the present invention is characterized in that the target layer is supported by the support substrate containing the polycrystalline diamond at the structure plane with a lower area density of monocrystalline domains showing the {101} plane than the area density of monocrystalline domains showing the {100} plane and the area density of monocrystalline domains showing the {111} plane.

Further, the target layer is supported at the structure plane with a normalized area density $NS_{101}$ of 33.3% or lower, such as the structure plane 24 or 26 of the diamond specimen 500 illustrated in FIG. 5A. Further, the target layer is desirably supported at the structure plane with a normalized area density $NS_{101}$ of 20% or lower, such as the structure plane 24 of the diamond specimen 500.

The method for identifying the area density of the plane orientation of the polycrystalline diamond is not limited to the EBSD method described above, and an X-ray diffraction (XRD) method or a method using a combination of transmission electron microscopy (TEM) and electron beam diffraction (ED) can also be used.

In the XRD method, the area density of the plane orientation is identified by calculating the abundance ratio of the plane orientation from a diffraction peak angle 2θp and intensity. Further, in the method using the combination of TEM and ED, the area density of the plane orientation is identified by preparing a slice test subject processed by focused ion beams (FIB) and then identifying the crystal orientation and the area of each crystal domain.

The following describes a first example. The X-ray generating tube 102 including a target according to an exemplary embodiment of the present invention and the X-ray generating apparatus 101 were produced by the procedure described below, and the X-ray generating apparatus 101 was operated to evaluate the output stability.

The configuration of the target 9 prepared in the first example is illustrated in FIG. 1A.

The target 9 of the first example was prepared as follows.

First, the free-standing polycrystalline diamond 21 in the shape of a disk with a diameter of 5 mm and a thickness of 1 mm that was produced by chemical vapor deposition was prepared. The polycrystalline diamond 21 includes bottom faces 24 and 25 and a side face 26 as structure planes. The polycrystalline diamond 21 was processed by a ultra-violet (UV) ozone asher apparatus to clean residual organic materials on the structure planes, whereby the support substrate 21 was obtained.

Prior to the deposition of the target layer 22, the structure planes of the support substrate 21 used in the first example were observed using the EBSD method, and the normalized area density of the {101} plane was calculated for each structure plane of the support substrate 21.

The obtained area densities $S_{101}$, $S_{100}$, and $S_{111}$ of the respective plane orientation components of the respective structure planes of the support substrate 21 and the normalized area density $NS_{101}$ of the {101} plane are shown in Table 1.

TABLE 1

| | Bottom face 24 | Bottom face 25 | Side face 26 |
|---|---|---|---|
| $S_{101}$ (%) | 7.5 | 21.2 | 10.7 |
| $S_{100}$ (%) | 10.5 | 9.7 | 24.3 |
| $S_{111}$ (%) | 25.2 | 24.9 | 20.1 |
| $NS_{101}$ (%) | 17.3 | 38.0 | 19.4 |

From the obtained results, it was found that each of the bottom face 24 and the side face 26 is a structure plane with a lower area density of monocrystalline domains showing the {101} plane than the area density of monocrystalline domains showing the {100} plane and the area density of monocrystalline domains showing the {111} plane. Further, it was also found that the bottom face 25 is a structure plane with the area density of monocrystalline domains showing the {101} plane that is lower than the area density of monocrystalline domains showing the {111} plane but higher than the area density of monocrystalline domains showing the {100} plane.

Next, a metal containing layer containing tungsten and having a layer thickness of 5 μm was formed by spattering on the bottom face 24 of the support substrate 21 by use of argon gas as a carrier gas and a sintered product of tungsten as a spattering target, whereby a layered product was produced.

The obtained layer product was subjected to sintering processing in a vacuum image furnace to produce the target 9 including the target layer 22 containing tungsten carbide. The layer thickness of the target layer 22 was 7 μm.

Next, a brazing filler metal (not illustrated) containing a tin-silver alloy was provided for an outer edge of the target layer 22 and for the side face 26 of the support substrate 21, and the tubular anode member 42 and the target 9 were joined together via the brazing filler metal to prepare the anode 52 illustrated in FIG. 2.

Next, the X-ray generating tube 102 illustrated in FIG. 2 was prepared using the anode 52. The static dielectric strength of the X-ray generating tube 102 was tested, and a tube voltage 150 kV was maintained continuously for 10 minutes without discharge. The static dielectric strength test is conducted to evaluate the discharge dielectric strength by applying a tube voltage across the anode 52 and the cathode 51 without operating the electron emission source 3 of the X-ray generating tube 102. Stated differently, the static dielectric strength test is conducted without emission of an electron beam flux 5 from the electron emitting unit 2.

Next, a tube voltage circuit 103 was electrically connected to the cathode 51 and the anode 52 of the X-ray generating tube 102, and the X-ray generating tube 102 and the tube voltage circuit 103 were placed in the inner portion 43 of the container 120 to prepare the X-ray generating apparatus 101 illustrated in FIG. 3.

Figure 6:
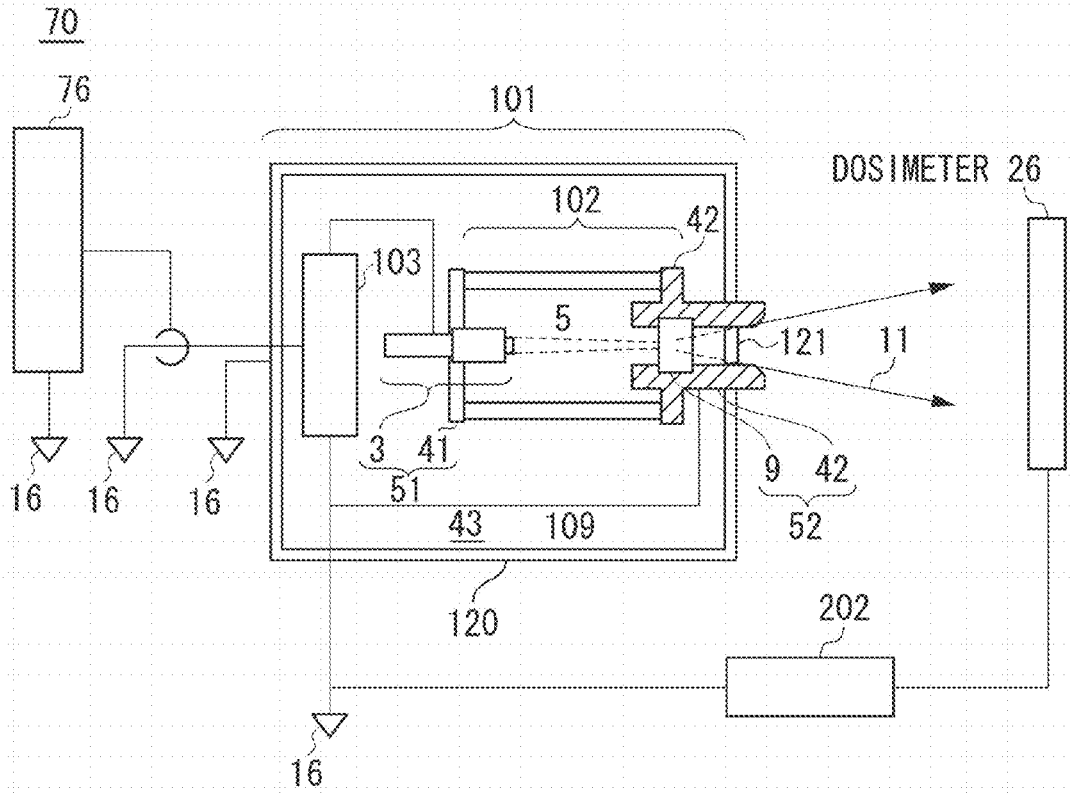
FIG. 6 is a configuration diagram illustrating an evaluation system configured to evaluate the output stability of an X-ray generating apparatus.

Next, the evaluation system 70 illustrated in FIG. 6 was prepared to evaluate the driving stability of the X-ray generating apparatus 101. In the evaluation system 70, a dosimeter 26 is disposed 1 m anteriorly to the X-ray transmission window 121 of the X-ray generating apparatus 101. The dosimeter 26 is connected to the tube voltage circuit 103 via the system control unit 202 to measure the radiation output intensity of the X-ray generating apparatus 101.

Driving conditions used in the driving stability evaluation were as follows. The tube voltage of the X-ray generating tube 102 was 110 kV. The current density of the electron beam irradiating the target layer 22 was 22 mA/mm$^2$. Pulse driving was employed to alternately repeat an electron irradiation period of 1 second and a non-irradiation period of 35 seconds. The mean value of detected X-ray output intensities during one second at the middle of the electron irradiation period was adopted. Specifically, the driving conditions in the driving stability evaluation conducted in the first example were to conduct the irradiation operation 100 times per hour.

The stability of X-ray output intensity was evaluated using a holding ratio obtained by normalizing by the initial X-ray output intensity the X-ray output intensity after the elapse of 100 hours from the start of the X-ray output.

In the X-ray output intensity stability evaluation, an X-ray tube current passing from the target layer 22 to a ground electrode 16 was measured, and constant current control is performed using a negative feedback circuit (not illustrated) to control a fluctuation value of an electron current irradiating the target layer 22 at 1% or lower. Further, it was confirmed, by use of a discharge counter 76, that the X-ray generating apparatus 101 is stably driving without discharging during the stability driving evaluation.

The X-ray output holding ratio of the X-ray generating apparatus 101 according to the first example was 0.99, and no discharge was observed during the irradiation operation conducted 10000 times. It was confirmed that no significant fluctuation in X-ray output of the X-ray generating apparatus 101 including the target 9 according to the first example is observed even after a long-term driving history and stable X-ray output intensity can be obtained. Further, the X-ray generating apparatus 101 was opened after the X-ray output intensity stability evaluation to remove the anode 52, but no peeling of the target layer 22 was observed.

In a second example, the X-ray imaging system 60 illustrated in FIG. 4 was prepared using the X-ray generating apparatus 101 described in the first example.

The X-ray imaging system 60 according to the second example included the X-ray generating apparatus 101 with reduced fluctuation in X-ray output so that a radiographic image with a high signal-to-noise (SN) ratio could be obtained.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-087465 filed Apr. 21, 2014, which is hereby incorporated by reference herein in its entirety.

What is claimed is:

1. A target comprising;

a target layer configured to be irradiated with an electron to generate an X-ray, and a support substrate configured to support the target layer, wherein the support substrate is a polyhedron containing a polycrystalline diamond and including multiple structure planes each of which has a normal line from one another, and wherein the target layer is supported by the support substrate at a structure plane with a smaller area density of a monocrystalline domain showing a {101} plane than each of an area density of a monocrystalline domain showing a {100} plane and an area density of a monocrystalline domain showing a {111} plane.

2. The target according to claim 1, wherein the support substrate is a free-standing polycrystalline diamond formed by growing a crystal of polycrystalline diamond on a seed crystal substrate by chemical vapor deposition and then removing the seed crystal substrate, and the structure plane supporting the target layer is a plane on a side of the support substrate from which the seed crystal substrate has been removed.

3. The target according to claim 1, wherein the target layer contains a target metal selected at least from tungsten, tantalum, and molybdenum.

4. The target according to claim 3, wherein the target layer contains a carbide of the target metal.

5. The target according to claim 1, wherein the target is a transmissive target in which an X-ray generated at the target layer is released from a structure plane of the support substrate that is on an opposite side from the structure plane supporting the target layer.

6. An anode comprising:

the target according to claim 1; and an anode member electrically connected to the target layer.

7. The anode according to claim 6, wherein the anode member includes an opening and is connected to a periphery of the support substrate in the opening.

8. An X-ray generating tube comprising:

the anode according to claim 6;

a cathode including an electron emission source configured to irradiate the target layer with an electron beam flux; and an insulation tube connected to the anode and the cathode at opposite ends in a tube axis direction.

9. An X-ray generating apparatus comprising:

the X-ray generating tube according to claim 8; and a tube voltage circuit configured to apply tube voltage across the anode and the cathode.

10. An X-ray imaging system comprising:

the X-ray generating apparatus according to claim 9; and an X-ray detection unit configured to detect an X-ray emitted from the X-ray generating apparatus and having passed through a subject.

11. A target comprising a target layer configured to be irradiated with an electron to generate an X-ray and a support substrate configured to support the target layer, wherein the support substrate is a polyhedron containing a polycrystalline diamond and including multiple structure planes each of which has a normal line from one another, wherein the target layer is supported by the support substrate at a structure plane with a smaller normalized area density of a monocrystalline domain showing a {101} plane than each of a normalized area density of a monocrystalline domain showing a {100} plane and a normalized area density of a monocrystalline domain showing a {111} plane, wherein the area densities in the multiple structure planes are denoted by $S_{101}$, $S_{100}$, and $S_{111}$ corresponding to plane orientations {101}, {100}, and {111}, and each of the area densities of the multiple structure planes is a normalized area density obtained by normalizing by an area of the structure plane a total value of areas of monocrystalline domains showing a plane orientation with an angle of deviation of 10 degrees of smaller from a central axis of the plane orientation, and wherein normalized area densities $NS_{101}$, $NS_{100}$, and $NS_{111}$ corresponding to the plane orientations {101}, {100}, and {111} are represented by general formulas 1 to 3:

$$NS_{101}=S_{101}/(S_{101}+S_{100}+S_{111}) \quad \text{(general formula 1);}$$

$$NS_{100}=S_{100}/(S_{101}+S_{100}+S_{111}) \quad \text{(general formula 2); and}$$

$$NS_{111}=S_{111}/(S_{101}+S_{100}+S_{111}) \quad \text{(general formula 3).}$$

12. The target according to claim 11, wherein the target layer is supported at the structure plane with the normalized area density $NS_{101}$ of the monocrystalline domain showing the {101} plane, of 33.3% or lower.

13. The target according to claim 12, wherein the target layer is supported at the structure plane with the normalized area density $NS_{101}$ of the monocrystalline domain showing the {101} plane, of 20% or lower.

14. The target according to claim 11, wherein the target is a transmissive target in which an X-ray generated at the target layer is released from a structure plane of the support substrate that is on an opposite side from the structure plane supporting the target layer.

15. An anode comprising:

the target according to claim 11; and an anode member electrically connected to the target layer.

16. The anode according to claim 15, wherein the anode member includes an opening and is connected to a periphery of the support substrate in the opening.

17. An X-ray generating tube comprising:

the anode according to claim 15;

a cathode including an electron emission source configured to irradiate the target layer with an electron beam flux; and an insulation tube connected to the anode and the cathode at opposite ends in a tube axis direction.

18. An X-ray generating apparatus comprising:

the X-ray generating tube according to claim 17; and a tube voltage circuit configured to apply tube voltage across the anode and the cathode.

19. An X-ray imaging system, comprising:

the X-ray generating apparatus according to claim 18; and an X-ray detection unit configured to detect an X-ray emitted from the X-ray generating apparatus and having passed through a subject.

* * * * *